US008273292B2

(12) United States Patent
Sakamoto et al.

(10) Patent No.: US 8,273,292 B2
(45) Date of Patent: Sep. 25, 2012

(54) STEEL FOR MACHINE AND STRUCTURAL USE HAVING EXCELLENT MACHINABILITY

(75) Inventors: Koichi Sakamoto, Kobe (JP); Motohiro Horiguchi, Kobe (JP); Shogo Murakami, Kobe (JP); Hiroshi Yaguchi, Kobe (JP); Shinsuke Masuda, Kobe (JP); Koichi Akazawa, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 165 days.

(21) Appl. No.: 12/809,107

(22) PCT Filed: Jan. 20, 2009

(86) PCT No.: PCT/JP2009/050721

§ 371 (c)(1),
(2), (4) Date: Jun. 18, 2010

(87) PCT Pub. No.: WO2009/096260

PCT Pub. Date: Aug. 6, 2009

(65) Prior Publication Data

US 2011/0229363 A1 Sep. 22, 2011

(30) Foreign Application Priority Data

Jan. 28, 2008 (JP) ..... 2008-016653

(51) Int. Cl.
*C22C 38/18* (2006.01)

(52) U.S. Cl. ..... 420/84; 420/104; 148/320; 148/333

(58) Field of Classification Search ..... 148/320, 148/333; 420/84, 104
See application file for complete search history.

(56) References Cited

U.S. PATENT DOCUMENTS

| | | | | |
|---|---|---|---|---|
| 4,434,006 | A | 2/1984 | Kato et al. | |
| 6,579,385 | B2 | 6/2003 | Yaguchi et al. | |
| 6,596,227 | B2 | 7/2003 | Shindo et al. | |
| 7,666,350 | B2 | 2/2010 | Yaguchi et al. | |
| 2010/0024923 | A1* | 2/2010 | Sugimura et al. | 148/320 |
| 2010/0098577 | A1* | 4/2010 | Sugimura et al. | 420/83 |

FOREIGN PATENT DOCUMENTS

| | | |
|---|---|---|
| JP | 55 152152 | 11/1980 |
| JP | 2000 34538 | 2/2000 |
| JP | 2000 219936 | 8/2000 |
| JP | 2001 214239 | 8/2001 |
| JP | 2001 214240 | 8/2001 |
| JP | 2003 55735 | 2/2003 |
| JP | 2003 213368 | 7/2003 |
| JP | 2004 91886 | 3/2004 |
| JP | 2005 272903 | 10/2005 |
| JP | 2005 273000 | 10/2005 |
| JP | 2006-104506 | 4/2006 |
| KR | 10-2006-0127068 | 12/2006 |

OTHER PUBLICATIONS

English translation of Japanese patent 2005-029888, Sakamoto Koichi et al., Feb. 3, 2005.*

"Trend of the Inclusion Morphology Control Technology in Free Cutting Steels and the Recent Cutting Technology", 182th/183rd Nishiyama Kinen Gijutsu Koza, The Iron and Steel Institute of Japan, pp. 181 to 226, Kaizaibutsu Seigyo, (Oct. 22, 2004).

U.S. Appl. No. 12/665,228, filed Dec. 17, 2009, Masuda, et al.

Korean Office Action dated May 2, 2012 issued in corresponding Korean Application No. 10-2010-7016830 filed Jan. 20, 2009 (w/English translation).

* cited by examiner

*Primary Examiner* — Deborah Yee

(74) *Attorney, Agent, or Firm* — Oblon, Spivak, McClelland, Maier & Neustadt, L.L.P.

(57) ABSTRACT

The present invention provides a steel for machine and structural use which sustains mechanical properties such as strength by reducing S content, and exerts excellent machinability (in particular, tool life) in both of intermittent cutting with HSS tools and continuous cutting with carbide tools. The invention relates to a steel for machine and structural use which contains an oxide inclusion containing, wherein a total mass of an average composition of the oxide inclusions is 100%: CaO: 10 to 55 mass %; $SiO_2$: 20 to 70 mass %; $Al_2O_3$: more than 0 and 35 mass % or less; MgO: more than 0 and 20 mass % or less; MnO: more than 0 and 5 mass % or less; and one or more members selected from the group consisting of $Li_2O$, $Na_2O$, $K_2O$, BaO, SrO and $TiO_2$: 0.5 to 20 mass % in total.

10 Claims, No Drawings

STEEL FOR MACHINE AND STRUCTURAL USE HAVING EXCELLENT MACHINABILITY

TECHNICAL FIELD

The present invention relates to a steel for machine and structural use which is to be cut for producing machine parts. More specifically, it relates to a steel for machine and structural use which shows excellent machinability both in continuous cutting such as turning and intermittent cutting such as hobbing, and never suffers from a decrease in strength even after conducting a surface hardening treatment such as carburizing or carbonitriding.

BACKGROUND ART

In producing gears, shafts, pulleys, constant-velocity joints and so on to be used in various gear transmission devices such as automotive transmissions and differentials and structural parts such as crank shafts and con rods, it is a common practice to conduct forging or the like, followed by cutting into a final shape. Since the cutting cost accounts for a large part of the production cost, a steel constituting the structural parts as described above should has good machinability.

On the other hand, such a structural part as described above is molded into the final shape and then subjected to a surface hardening treatment, e.g., carburizing or carbonitriding (involving treatments under atmospheric pressure, reduced pressure, vacuum or plasma atmosphere), if necessary, followed by quenching/tempering, high-frequency quenching or the like to ensure a definite strength. However, the strength is sometimes lowered during such a treatment. In particular, there is a problem that the strength in the direction perpendicular to the rolling direction (which is commonly called the transverse direction) is liable to lower.

There has been known that lead (Pb) is an element capable of improving the machinability of a steel for machine and structural use without lowering the strength. Namely, Pb is an element which is highly effective for improving machinability. However, it has been pointed out that Pb is harmful to human body. Moreover, Pb causes additional troubles such as a lead fume in melting and a need for processing cutting dusts. Accordingly, there has been recently required a steel containing no Pb (Pb-free) and yet exhibiting good machinability.

As a technique for ensuring good machinability without adding Pb, there have been known steels in which the S content is increased up to about 0.06%. However, this technique suffers from a problem that the mechanical properties (toughness and fatigue strength) are frequently lowered and there is a limit to increase the S content. This is seemingly because a sulfide (MnS) expands long in the rolling direction and thus causes lowering in the toughness in the transverse direction. In a part which requires high strength, it is particularly necessary to reduce the S content as much as possible. From these viewpoints, it is required to establish a technique that good machinability can be further improved without positively adding Pb or S.

Under these circumstances, various techniques have been proposed to establish good machinability without positively adding Pb or S. In particular, studies have been made on the relationship between inclusions in the steel and machinability (see, for example, Patent Document 1). Further, various techniques have been proposed concerning the control of inclusions.

For example, Patent Document 1 discloses a technique of improving the machinability of a Ti-added high-strength steel by adding Ca in the presence of a definite amount of oxygen and Ti and thus allowing the coexistence of sulfides containing Ca and oxides containing Ca contributing to the improvement in machinability. Patent Document 2 discloses a steel for machine and structural use wherein the amount of sulfides containing Ca or oxides is controlled by adjusting Ca/Al ratio so as to give stable machinability with regulated variation in tool life.

Patent Document 3 or 4 discloses a technique of regulating variation in machinability by ensuring at least a specific area ratio of sulfides inclusion containing Ca in an amount of 0.3 to 40%, or by ensuring at least a specific count of sulfides containing Ca in an amount of 0.1 to 10%. Moreover, Patent Documents 5 and 6 disclose a technique of improving the machinability of a steel for machine and structural use by using an inclusion having a double structure which contains a core made of a oxide containing Ca and a surrounding area thereof made of a sulfide containing Ca.

Patent Document 7 discloses a technique of improving the machinability (in particular, chip-disposability and tool life) by lowering the melting point of oxides by adding Ca and refining sulfide inclusions by inhibiting the solute of Ca in sulfide inclusions (in particular, MnS) through the regulation of the steel making conditions.

Non-patent Document 1: 182th/183rd Nishiyama Kinen Gijutsu Koza, The Iron and Steel Institute of Japan, pp. 181 to 226, Kaizaibutsu Seigyo, Oct. 22, 2004 in Tokyo, November 12 in Kobe Patent Document 1: JP-A-2005-272903
Patent Document 2: JP-A-2005-273000
Patent Document 3: JP-A-2000-34538
Patent Document 4: JP-A-2000-219936
Patent Document 5: JP-A-2003-55735
Patent Document 6: JP-A-2004-91886
Patent Document 7: JP-A-2003-213368

DISCLOSURE OF THE INVENTION

Problems that the Invention is to Solve

For example, a process for producing a gear which is one of structural parts commonly comprises forging a steel for machine and structural use (starting material), roughly cutting by hobbing, finishing by shaving, conducting a heat treatment such as carburizing and then polishing again (horning). In this process, however, the heat treatment results in a large strain which cannot be sufficiently corrected merely by the polishing. As a result, the dimensional accuracy of the part is lowered in some cases. In recent years, it is required that gears have a good dimensional accuracy to control noise in use. As a countermeasure therefor, grinding (hard finishing) is sometimes conducted before the polishing as described above.

In the case of using either production process, a large number of steps are required and cost required at cutting and grinding is high. Thus, it has been needed to reduce the total process cost. Therefore, the cost should be reduced in each step and there are large expectations for a steel enabling the cost reduction. In the hobbing step that is common to both processes, tools are expensive. Therefore, it has been also required to establish a technique for prolonging the tool life.

The hobbing as described above corresponds to intermittent cutting. As the tools used in the hobbing, the tools fabricated by coating high-speed steel tools with AlTiN or the like (hereinafter sometimes abbreviated as "HSS tools") are mainly employed in these days. On the other hand, tools fabricated by coating cemented carbide with AlTiN or the like (hereinafter sometimes abbreviated as "carbide tools") have a problem of frequently suffering from "chipping" when applied to annealed materials. Because of this, these tools are employed in "continuous cutting" such as turning.

In the intermittent cutting and continuous cutting as described above differ in cutting mechanism. Thus, tools suitable for the individual cutting are selected. It is desirable that a steel for machine and structural use to be cut should have a property of exerting excellent machinability in both cutting. However, cutting by the hobbing using HSS tools (intermittent cutting) brings about a problem that the tools are liable to be oxidized and worn at a low speed and a low temperature compared with continuous cutting such as turning using carbide tools. Therefore, it is required that a steel for machine and structural use to be subjected to intermittent cutting such as hobbing has, in particular, an extended tool life in the machinability.

The invention, which has been completed focusing on the above-described circumstances, aims at providing a steel for machine and structural use which sustains mechanical properties such as strength by reducing S content, and exerts excellent machinability (in particular, tool life) in both of intermittent cutting (for example, bobbing) with HSS tools and continuous cutting (for example, turning) with carbide tools.

Means for Solving the Problems

The steel for machine and structural use according to the invention by which the above object can be achieved is a steel for machine and structural use having excellent machinability, which contains an oxide inclusion containing, wherein a total mass of an average composition of the oxide inclusions is 100%:

CaO: 10 to 55 mass %;

$SiO_2$: 20 to 70 mass %;

$Al_2O_3$: more than 0 and 35 mass % or less;

MgO: more than 0 and 20 mass % or less;

MnO: more than 0 and 5 mass % or less; and one or more members selected from the group consisting of $Li_2O$, $Na_2O$, $K_2O$, BaO, SrO and $TiO_2$: 0.5 to 20 mass % in total.

The oxide inclusions in the steel for machine and structural use according to the invention preferably contains as the average composition:

CaO: 10 to 50 mass %;

$SiO_2$: 20 to 70 mass %;

$Al_2O_3$: 7 to 35 mass %;

MgO: 1 to 13 mass %;

MnO: 1 to 3 mass %; and one or more members selected from the group consisting of $Li_2O$, $Na_2O$, $K_2O$, BaO, SrO and $TiO_2$: 2 to 6 mass % in total.

Although the composition of the chemical components of the steel for machine and structural use according to the invention is not particularly restricted so long as it is a steel for machine and structural use. The preferable example thereof includes, for example, a steel for machine and structural use which contains:

C: 0.1 to 1.2 mass %;

Si: 0.03 to 2 mass %;

Mn: 0.3 to 1.8 mass %;

P: more than 0 and 0.03 mass % or less;

S: more than 0 and 0.02 mass % or less;

Cr: 0.3 to 2.5 mass %;

Al: 0.0001 to 0.01 mass %;

Ca: 0.0001 to 0.005 mass %;

Mg: 0.0001 to 0.005 mass %;

N: more than 0 and 0.009 mass % or less;

O: more than 0 and 0.005 mass % or less;

at least one of one or more elements selected from the group consisting of Li, Na, K, Ba and Sr: 0.00001 to 0.0050 mass % in total;

and

Ti: 0.01 to 0.5 mass %; and a reminder containing an iron and an inevitable impurity.

If necessary, it is effective that the composition of the chemical components as described above further contains Mo in an amount of more than 0 and 0.5 mass % or less, and the properties of the steel are further improved thereby.

Advantage of the Invention

According to the invention, the S content is reduced to thereby elevate the strength and each component of oxide inclusions is appropriately controlled to thereby lower the melting point of the inclusions as a whole and facilitate the deformation thereof. As a result, it becomes possible to obtain a steel for machine and structural use which exerts excellent machinability (in particular, tool life) in both of intermittent cutting with HSS tools and continuous cutting with carbide tools.

BEST MODE FOR CARRYING OUT THE INVENTION

One of the properties of the steel for machine and structural use according to the invention is that the content of S as a chemical component is controlled to 0.02 mass % or less. Owing to the reduction of S content, mechanical properties such as strength of the steel can be ensured. However, reduction of S content is accompanied by a decrease in the sulfide inclusions which are effective for improving machinability. To make up for the decrease in the sulfide inclusions due to the reduction of the S content, it is an important point to improve the machinability (in particular, tool life) of a steel using oxide inclusions in the invention.

In the steel of the invention, the machinability (in particular, tool life) is improved not by using sulfide inclusions such as MnS but mainly by controlling the composition of oxide inclusions. Because of having a lowered melting point, the oxide inclusions contained in the steel according to the invention are molten by the heat during cutting and form a protective product (belag) film on the tool surface, which can reduce wear of the tools. The melting point of the oxide inclusions contained in the steel can be lowered by adjusting an average composition of the oxide inclusions to: CaO: 10 to 55%, $SiO_2$: 20 to 70%, $Al_2O_3$: 35% or less (not inclusive of 0%), MgO: 20% or less (not inclusive of 0%), MnO: 5% or less (not inclusive of 0%), and at least one member selected from the group consisting of $Li_2O$, $Na_2O$, $K_2O$, BaO, SrO and $TiO_2$: 0.5 to 20% in total, wherein the total mass of the average composition of the oxide inclusions is 100%. The reasons for specifying the composition are as follows. In addition, the average composition of the oxide inclusions can be measured, for example, by the following method.

The contents of oxides such as CaO, MgO, $Al_2O_3$, MnO, $SiO_2$, $Na_2O$, $K_2O$, BaO, SrO and $TiO_2$ are measured by X-ray microanalysis (EPMA) in a visual field of a cross-section of 25 $mm^2$ in the rolling direction of a steel. However, the concentration of $Li_2O$ in the oxide inclusions cannot be measured by EPMA. Thus, it is measured by secondary ion mass spectrometry (SIMS) in the following manner.

(1) Primary Standard Samples

1) A large number of synthetic oxides corresponding to the inclusion composition excluding $Li_2O$ and synthetic oxides in which $Li_2O$ is added thereto are prepared and the $Li_2O$ concentrations thereof are quantitatively measured by chemical analysis to give standard samples.

2) The relative secondary ionic strengths of Li to Si are determined for the individual synthetic oxides thus prepared.

3) Standard curves are drawn based on the relative secondary ionic strengths of Li to Si and the $Li_2O$ concentrations chemically analyzed in the above (1)-1).

(2) Secondary Standard Samples (for Correcting Measurement Environment)

1) To correct the measurement environment, standard samples are separately prepared by ion-injecting Li on Si wafers and the relative secondary ionic strengths of Li to Si are measured. Thus, correction is made at conducting (1)-2) as described above.

(3) Measurement in Practice

1) Each concentration of inclusions in steel such as CaO is measured by EPMA.

2) The relative secondary ionic strengths of Li to Si of the inclusions in the steel are measured. Among the standard curves drawn in the above (1)-3), the one closest to the analysis data of the above (3)-1) is selected and the $Li_2O$ content of the inclusions is determined therefrom.

The ratios of the oxide inclusions contained in the steel for machine and structural use according to the invention are not particularly restricted so long as a desired advantage of the invention can be obtained. However, it is preferable that ½ or more of the individual elements Al, Ca and Mg to be positively added for forming composite oxides having a low melting point undergo the formation of the oxides. It is more preferable that ¾ or more of the individual elements to be added undergo the formation of the oxides, more preferably ⅘ or more and still more preferably 9/10 or more.

Next, the reasons for specifying the limitations in the composition of the oxide inclusions contained in the steel for machine and structural use according to the invention will be described in detail for the individual components. Unless otherwise noted, all percent stated in the present description indicate mass percent.

[CaO: 10 to 55%]

CaO has effects of forming the most suitable composite structure of the oxide inclusions, lowering the melting point, sticking as a belag to the tool surface in the course of cutting and thus reducing wear of the tools. To exert these effects, the CaO content should be 10% or more based on the total mass of the oxide inclusions (the same applies to other components). When the CaO content exceeds 55% and becomes too large, however, CaO crystallizes and hardens the steel material, which shortens the tool life in cutting. The preferable upper limit of the CaO content is 50%.

[$SiO_2$: 20 to 70%]

$SiO_2$ is an essentially required component similar to CaO, $Al_2O_3$ and the like in forming soft and low-melting oxide inclusions. When the $SiO_2$ content is less than 20%, the oxide inclusions become large-sized or hard inclusions mainly containing CaO and $Al_2O_3$ and serve as the starting point of breakage. Thus, it is required to add $SiO_2$ in an amount of 20% or more, preferably 30% or more. In the case where the $SiO_2$ content is too large, however, the oxide inclusions become high-melting and hard inclusions mainly containing $SiO_2$ and possibly serve as the starting point of disconnection or breakage. Since this tendency becomes highly noticeable when the $SiO_2$ content exceeds 70%, it is very important to control the $SiO_2$ content to 70%) or less, preferably 65% or less, more preferably 45% or less and still more preferably 40% or less.

[$Al_2O_3$: More than 0 and 35% or Less]

With respect to $Al_2O_3$, the oxide inclusions may not substantially contain $Al_2O_3$ depending on an appropriately controlled composition containing CaO and $SiO_2$ as well as $Li_2O$, $Na_2O$, $K_2O$ or the like which are preferred to be contained therein in the invention. However, the presence of an appropriate amount of $Al_2O_3$ lowers the melting point of the oxide inclusions and softens the same. Thus, it is preferable that the oxide inclusions contain about 7% or more, and more preferably 10% or more of $Al_2O_3$. When the $Al_2O_3$ content in the oxide inclusions is too large, the oxide inclusions become alumina inclusions that are hard and can be hardly refined. As a result, it is difficult to refine in the hot rolling and they serve as the starting point of breakage or bending. Therefore, the $Al_2O_3$ content should be controlled to 35% or less at the largest, preferably about 30% or less.

[MgO: More than 0 and 20% or Less]

MgO is liable to induce the formation of hard inclusions containing $MgO/SiO_2$, thereby causing breakage or bending. These problems become noticeable when the MgO content exceeds 20%. To prevent these problems, therefore, it is preferable to control the MgO content to 20% or less. The preferable lower limit of the MgO content is 1% while the preferable upper limit thereof is 13%.

[MnO: More than 0 and 5% or Less]

Although MnO has an effect of lowering the melting point of the oxides containing $SiO_2$, it counterbalances for the effect of CaO. Thus, it is preferable to control the MnO content to 5% or less. The preferable lower limit of the MnO content is 1% while the preferable upper limit thereof is 3%.

[At Least One Member Selected from the Group Consisting of $Li_2O$, $Na_2O$, $K_2O$, BaO, SrO and $TiO_2$: 0.5 to 20%]

At least one member selected from the group consisting of $Li_2O$, $Na_2O$, $K_2O$, BaO, SrO and $TiO_2$ is the most specific and important component in the invention because of exerting a highly important effect in lowering the melting point and viscosity of the composite oxide inclusions having been formed. To facilitate the lowering in melting point and viscosity of the oxide inclusions and promote the refinement of the inclusions to thereby ensure the effect of improving machinability at such a level as intended in the invention, it is desirable that the total content of one or more members selected from the group consisting of $Li_2O$, $Na_2O$, $K_2O$, BaO, SrO and $TiO_2$ is 0.5% or more, more preferably 1% or more and still more preferably 2% or more. When the total content of one or more members selected from the group consisting of $Li_2O$, $Na_2O$, $K_2O$, BaO, SrO and $TiO_2$ exceeds 20%, however, the melting point of the oxide inclusions becomes too low and the melting loss to refractories is considerably elevated. As a result, the amount of hard inclusions originating in the elution of a liner refractory used is increased, which lowers the machinability on the contrary. Thus, the total content of one or more members selected from the group consisting of $Li_2O$, $Na_2O$, $K_2O$, BaO, SrO and $TiO_2$ should be controlled to 20% or less, preferably 15% or less.

By forming a structural part using a steel for machine and structural use wherein the ratios of the individual components of the oxide inclusions are appropriately controlled as described above, the obtained product can exert excellent machinability in both of intermittent cutting and continuous cutting.

In controlling the composition ratios of the oxide inclusions in the steel for machine and structural use according to the invention, it is desirable, in particular with respect to the contents of Si, Al and Ca, that the Al and Ca contents are determined depending on the Si content so as to give a melting point falling within a thermodynamically calculated low-melting point range.

Although the invention has been completed on an assumption that the steel is employed in structural parts and the species of the steel is not particularly restricted, it is preferable that the composition of the chemical components is controlled within an appropriate range to improve mechanical properties such as machinability and other properties. The reasons for restricting the ranges of the preferable composition of the chemical components that are determined from the above-described viewpoint are as follows.

[C: 0.1 to 1.2%]

C is an element that is effective for ensuring the core hardness of a part made of the steel for machine and structural use. When the C content is too large, however, the hardness is excessively elevated and the machinability is lowered. Therefore, it is preferable that the C content is controlled to 0.1% or more (more preferably 0.13% or more) and 1.2% or less (more preferably 1.1% or less).

[Si: 0.03 to 2%]

Si is an element that contributes to the improvement in the softening-resistance of a surface hardened layer. When the Si content is too large, however, the machinability in machine working and cold forging properties are lowered. Therefore, it is preferable that the Si content is controlled to 0.03% or more (more preferably 0.1% or more) and 2% or less (more preferably 0.7% or less).

[Mn: 0.3 to 1.8%]

Mn is an element that serves as a deoxidizing agent reducing the oxide inclusions to thereby improve the inner qualities of steel parts. Also, Mn is an effective element that improves hardenability during quenching and increases the core hardness and hardened layer depth of steel parts to thereby ensure strength of the parts. When the Mn content is too large, however, the grain boundary segregation of P is accelerated and the fatigue strength is lowered. Therefore, it is preferable that the Mn content is controlled to 0.3% or more (more preferably 0.5% or more) and 1.8% or less (more preferably 1.5% or less).

[P: More than 0 and 0.03% or Less]

P is an element (impurity) that is inevitably contained in steel. Because of promoting cracking in hot working, P should be reduced as far as possible. Thus, the P content is specified as 0.03% or less (more preferably 0.02% or less and still more preferably 0.01% or less). It is industrially difficult to reduce the P content to 0%.

[S: More than 0 and 0.02% or Less]

S reacts with Mn to form MnS inclusions thereby increasing the anisotropy of the impact strength of steel parts. Thus, it is preferable to reduce the S content as far as possible. Therefore, the S content is specified as 0.02% or less (more preferably 0.015% or less). It is industrially difficult to reduce the S content to 0%, since S is an impurity inevitably contained in steel.

[Cr: 0.3 to 2.5%]

Cr is an element that is important for elevating the hardenability during quenching of steel and ensuring stable hardened layer depth and required core hardness. In the case of using a steel for producing a structural part such as a gear, it is particularly effective for ensuring the static strength and fatigue strength of the part. When the Cr content is too large, however, Cr carbides are segmented around the prior γ grain boundaries and the fatigue strength is lowered. Thus, the Cr content is specified as 0.3% or more (more preferably 0.8% or more) and 2.5% or less (more preferably 2.0% or less).

[Al: 0.0001 to 0.01%]

Al is an element that is effective for forming composite oxides having a low melting point. When the Al content is too large, however, $Al_2O_3$ having a high melting point and a high hardness is formed in a large amount and promotes tool wearing in cutting. Thus, the Al content is specified as 0.0001% or more (more preferably 0.002% or more) and 0.01% or less (more preferably 0.005% or less).

[Ca: 0.0001 to 0.005%]

Ca is an element that is effective for forming composite oxides having a low melting point as described above. Also, Ca can suppress expansion of sulfides in steel to thereby control the anisotropy of impact properties. When the Ca content is too large, however, it is feared that coarse complex oxides containing Ca are formed to lower the strength. Thus, the Ca content is specified as 0.0001% or more (more preferably 0.0005% or more) and 0.005% or less (more preferably 0.003% or less).

[Mg: 0.0001 to 0.005%]

Mg is an element that is effective for forming composite oxides having a low melting point as described above. Also, Mg can suppress expansion of sulfides in steel to thereby control the anisotropy of impact properties, similar to Ca. When the Mg content is too large, however, it is feared that MgO having a high melting point and a high hardness is formed in a large amount to shorten the tool life. Thus, the Mg content is specified as 0.0001% or more (more preferably 0.0002% or more) and 0.005% or less (more preferably 0.002% or less).

[N: More than 0 and 0.009% or Less]

N forms nitrides together with other elements (Ti, etc.) and thus contributes to refinement of the structure. Thus, it is recommended to add N preferably in an amount of 0.002% or more, more preferably 0.004% or more. However, an excessively large N content exerts undesirable effects on hot workability and ductility. Thus, the upper limit of the N content is specified as 0.009% (more preferably 0.007%). It is industrially difficult to reduce the N content to 0%, since N is inevitably contained in steel.

[O: More than 0 and 0.005% or Less]

An excessively large 0 content causes the formation of coarse oxide inclusions and exerts undesirable effects on hot workability and ductility of steel. Thus, the upper limit of the O content is specified as 0.005% (more preferably 0.003%). However, O is required for ensuring complex oxides having a low melting point capable of forming belag. Therefore, it is recommended to add O preferably in an amount of 0.0005% or more, more preferably 0.0010% or more.

[One or More Elements Selected from the Group Consisting of Li, Na, K, Ba and Sr: 0.00001 to 0.0050% in Total, Ti: 0.01 to 0.5%]

These elements react with O in steel to give oxides which are incorporated into oxides containing CaO, $Al_2O_3$ and $SiO_2$ and form oxides having a low melting point (for example, $CaO—Al_2O_3—SiO_2—TiO_2$). Since these oxides stick to the tool surface as a belag, the machinability can be improved. In the case of using HSS tools coated with AlTiN, in particular, the stickiness of the belag formed by these oxides containing these elements is improved and thus wear of the tool can be further reduced. Among these elements, Ti reacts with C or N to form TiN, TiC, Ti(C, N) or the like and thus exerts another effect of preventing crystals from coarsening in carburizing. To achieve these effects, it is preferable that the total content of Li, Na, K, Ba and Sr is 0.00001% or more (more preferably 0.0001% or more) and the content of Ti is 0.01% or more. When the elements such as Li, Na, K, Ba and Sr are contained in excess, however, refractories supporting molten steel sometimes suffer from melting loss. Therefore, it is preferable to control the total content of these elements to 0.0050% or less. When the Ti content is too large, coarse carbides having a high hardness are formed and the machinability and toughness are lowered. It is therefore preferable to control the Ti content to 0.5% or less.

The composition of the fundamental components of the steel for machine and structural use according to the invention is as described above while the reminder is substantially iron, though it is accepted that the steel further contains inevitable impurities (for example, As, Sb, Sn, Te, Ta, Co, rare earth metals or the like) which might be incorporated depending on the conditions of feedstocks, materials, production facilities or the like. If necessary, the steel for machine and structural use of the invention may further contain the following optional elements.

[Mo: More than 0 and 0.5% or Less and/or B: More than 0 and 0.005% or Less]

The elements Mo and B, which are both effective for improving hardenability during quenching, may be contained in steel, if necessary. More specifically, Mo ensures the hardenability during quenching of a matrix and, therefore, is effective for supressing the formation of incompletely hardened structures. In addition to the effect of largely improving the hardenability during quenching, B has another effect of reinforcing crystal grain boundaries and elevating the impact strength of steel. It is therefore recommended to add Mo preferably in an amount of 0.05% or more, more preferably 0.10% or more and B in an amount of 0.0005% or more, more preferably 0.0008% or more to steel.

When the Mo content is too large, however, the core hardness is unnecessarily increased and the machinability in machine working and cold forging properties are lowered. When the B content is too large, the amount of B nitride formed together with N is increased and the cold and hot workabilities are lowered. In the case of adding these elements, therefore, the upper limit of Mo is specified as 0.5% (more preferably 0.4%) and the upper limit of B is specified as 0.005% (more preferably 0.003%).

[Bi: More than 0 and 0.1% or Less]

Bi, which is an element improving the machinability of steel, may be added to steel if necessary. To exert the above effect, it is recommended to add 0.02% or more of Bi to steel. When the Bi content is too large, however, the strength is lowered. In the case of adding Bi to steel, therefore, the upper limit thereof is specified as 0.1% (preferably 0.08%).

[Cu: More than 0 and 0.5% or Less]

Cu, which is an element effective for improving the weatherability, may be added to steel if necessary. For this purpose, it is recommended to add 0.1% or more of Cu to steel. When the Cu content is too large, however, the hot workability and ductility of the steel are lowered and cracks and marks frequently arise. In the case of adding Cu to steel, therefore, the upper limit thereof is specified as 0.5% (preferably 0.3%).

[Ni: More than 0 and 2% or Less]

Ni, which is an element solidified in a matrix and is effective for improving toughness, may be added to steel if necessary. It is recommended to add Ni preferably in an amount of 0.1% or more to steel. When the Ni content is too large, however, bainite and martensite structure excessively develop to lower toughness. In the case of adding Ni, therefore, the upper limit thereof is specified as 2% (preferably 1%).

[At Least One Member Selected from the Group Consisting of Zr: More than 0 and 0.02% or Less, V: More than 0 and 0.5% or Less, and W: More than 0 and 1.0% or Less]

Zr, V and W, which are elements forming fine carbides, nitrides or carbonitrides together with C and/or N and being effective for preventing grain growth, may be added to steel if necessary. Thus, it is recommended to add one or more members selected from the group consisting of Zr, V and W to steel in such an amount as specified above. When the content thereof is too large, however, hard carbides are formed and the coatability are deteriorated. Thus, the contents thereof are restricted to the upper limits as defined above.

EXAMPLES

Next, the invention will be described in greater detail by reference to the following Examples. Needless to say, the invention is not restricted to the following Examples but various modifications can be made without departing from the scope and principles of the invention that are described hereinbelow and hereinafter and all of these modifications fall within the technical scope of the invention.

150 kg of each steel having the chemical component composition shown in the following Table 1 was molten in a vacuum induction furnace and forged to an ingot of 200 mm in diameter. After forging (soaking: for about 3 hours at 1250° C., heat forging: about 1 hour at 1000° C.) and cutting, the obtained steel plate (thickness: 30 mm, width: 100 mm, length: 145 mm) was annealed (2 hours at 900° C. followed by air-cooling). Thus, a plate-shape sample was obtained. With respect to the composition of oxide inclusions, the Al and Ca contents were determined depending on the Si content so as to give a melting point falling within a thermodynamically calculated low-melting point range.

TABLE 1

| | Composition of chemical component of steel* (mass %) | | | | | | | | | | | | | |
|---|---|---|---|---|---|---|---|---|---|---|---|---|---|---|
| No. | C | Si | Mn | P | S | Al | Cr | Mo | N | Mg | Ca | O | Li | Ti |
| A1 | 0.19 | 0.18 | 0.78 | 0.010 | 0.020 | 0.0002 | 1.10 | 0.19 | 0.0046 | 0.0002 | 0.0011 | 0.0017 | 0.00005 | — |
| A2 | 0.20 | 0.17 | 0.81 | 0.010 | 0.015 | 0.0002 | 1.12 | 0.00 | 0.0051 | 0.0001 | 0.0013 | 0.0019 | 0.00006 | — |
| A3 | 0.19 | 0.19 | 0.85 | 0.010 | 0.015 | 0.0002 | 1.28 | 0.19 | 0.0052 | 0.0002 | 0.0013 | 0.0016 | 0.00006 | — |
| A4 | 0.19 | 0.17 | 0.81 | 0.010 | 0.015 | 0.0002 | 1.12 | 0.19 | 0.0045 | 0.0002 | 0.0010 | 0.0018 | 0.00008 | — |
| A5 | 0.20 | 0.50 | 0.80 | 0.014 | 0.017 | 0.0004 | 1.21 | 0.20 | 0.0040 | 0.0015 | 0.0009 | 0.0019 | 0.00005 | — |
| A6 | 0.18 | 0.17 | 0.79 | 0.013 | 0.010 | 0.0003 | 1.15 | 0.19 | 0.0046 | 0.0002 | 0.0010 | 0.0022 | — | — |
| A7 | 0.19 | 0.20 | 0.78 | 0.013 | 0.010 | 0.0003 | 1.14 | 0.00 | 0.0060 | 0.0001 | 0.0009 | 0.0025 | — | — |
| A8 | 0.18 | 0.17 | 0.79 | 0.013 | 0.010 | 0.0003 | 1.15 | 0.19 | 0.0086 | 0.0001 | 0.0008 | 0.0021 | — | — |
| A9 | 0.21 | 0.19 | 0.80 | 0.011 | 0.013 | 0.0005 | 1.16 | 0.18 | 0.0045 | 0.0002 | 0.0010 | 0.0018 | 0.00005 | — |
| A10 | 0.19 | 0.17 | 0.78 | 0.013 | 0.011 | 0.0006 | 1.12 | 0.19 | 0.0053 | 0.0004 | 0.0009 | 0.0019 | 0.00006 | — |
| A11 | 0.19 | 0.70 | 0.8 | 0.011 | 0.018 | 0.0007 | 1.18 | 0.17 | 0.0045 | 0.0002 | 0.0010 | 0.0020 | 0.00007 | — |
| A12 | 0.21 | 0.18 | 0.76 | 0.014 | 0.016 | 0.0007 | 1.21 | 0.17 | 0.0075 | 0.0002 | 0.0011 | 0.0021 | — | — |
| A13 | 0.19 | 0.45 | 0.80 | 0.011 | 0.018 | 0.0007 | 1.18 | 0.17 | 0.0069 | 0.0001 | 0.0009 | 0.0023 | — | — |
| A14 | 0.20 | 0.17 | 0.81 | 0.010 | 0.017 | 0.0005 | 1.13 | 0.18 | 0.0048 | 0.0005 | 0.0012 | 0.0015 | 0.00005 | — |

TABLE 1-continued

| No. | Composition of chemical component of steel* (mass %) | | | | | | | | | | | | | |
|---|---|---|---|---|---|---|---|---|---|---|---|---|---|---|
| | C | Si | Mn | P | S | Al | Cr | Mo | N | Mg | Ca | O | Li | Ti |
| A15 | 0.19 | 0.18 | 0.77 | 0.012 | 0.011 | 0.0006 | 1.12 | 0.19 | 0.0053 | 0.0002 | 0.0013 | 0.0016 | — | — |
| A16 | 0.21 | 0.20 | 0.78 | 0.014 | 0.011 | 0.0005 | 1.14 | 0.19 | 0.0055 | 0.0002 | 0.0011 | 0.0014 | 0.00005 | — |
| A17 | 0.21 | 0.18 | 0.81 | 0.013 | 0.013 | 0.0003 | 1.12 | 0.19 | 0.0053 | 0.0002 | 0.0015 | 0.0017 | 0.00004 | — |
| A18 | 0.19 | 0.21 | 0.78 | 0.014 | 0.011 | 0.0002 | 1.12 | 0.19 | 0.0053 | 0.0002 | 0.0012 | 0.0015 | — | 0.01 |
| A19 | 0.19 | 0.17 | 0.77 | 0.013 | 0.012 | 0.0002 | 1.12 | 0.19 | 0.0053 | 0.0002 | 0.0011 | 0.0016 | 0.00006 | — |
| B1 | 0.21 | 0.19 | 0.81 | 0.020 | 0.019 | 0.0300 | 1.11 | 0.17 | 0.0050 | 0.0003 | 0.0004 | 0.0011 | — | — |
| B2 | 0.21 | 0.19 | 0.80 | 0.020 | 0.017 | 0.0300 | 1.11 | 0.17 | 0.0050 | 0.0001 | 0.0005 | 0.0010 | — | — |
| B3 | 0.19 | 0.20 | 0.83 | 0.017 | 0.013 | 0.0300 | 1.12 | 0.17 | 0.0046 | <0.0001 | 0.0028 | 0.0013 | — | — |

*The reminder contains iron and inevitable impurities.

With respect to the oxide inclusions contained in the samples obtained above, the contents of oxides such as CaO, MgO, $Al_2O_3$, MnO, BaO, SrO, $TiO_2$ and on the like were measured by X-ray microanalysis (EPMA) in a visual field of a cross-section of 25 $mm^2$ in the rolling direction of a steel. The following Table 2 shows the obtained data.

However, the concentration of $Li_2O$ in the oxide inclusions could not be measured by EPMA. Thus, it was measured by secondary ion mass spectrometry (SIMS) in the following manner. The following Table 2 shows the obtained data.

(1) Primary Standard Samples

1) A large number of synthetic oxides corresponding to the inclusion composition excluding $Li_2O$ and synthetic oxides in which $Li_2O$ was added thereto were prepared and the $Li_2O$ concentrations thereof were quantitatively measured by chemical analysis to give standard samples.

2) The relative secondary ionic strengths of Li to Si were determined for the individual synthetic oxides thus prepared.

3) Standard curves were drawn based on the relative secondary ionic strengths of Li to Si and the $Li_2O$ concentrations chemically analyzed in the above (1)-1).

(2) Secondary Standard Samples (for Correcting Measurement Environment)

1) To correct the measurement environment, standard samples were separately prepared by ion-injecting Li on Si wafers and the relative secondary ionic strengths of Li to Si were measured. Thus, correction was made at conducting (1)-2) as described above.

(3) Measurement in Practice

1) Each concentration of inclusions in steel such as CaO was measured by EPMA.

2) The relative secondary ionic strengths of Li to Si of the inclusions in the steel were measured. Among the standard curves drawn in the above (1)-3), the one closest to the analysis data of the above (3)-1) was selected and the $Li_2O$ content of the inclusions was determined therefrom.

TABLE 2

| No. | Average composition of inclusions (mass %) | | | | | | | | | | | | Average inclusion composition |
|---|---|---|---|---|---|---|---|---|---|---|---|---|---|
| | CaO | $Al_2O_3$ | $SiO_2$ | MgO | MnO | $Li_2O$ | $Na_2O$ | $K_2O$ | BaO | SrO | $TiO_2$ | Total | |
| A1 | 25 | 21 | 50 | 1 | 1 | 2 | — | — | — | — | — | 100 | CaO—$Al_2O_3$—$SiO_2$ |
| A2 | 24 | 18 | 51 | 1 | 1 | 3 | — | — | 2 | — | — | 100 | CaO—$Al_2O_3$—$SiO_2$ |
| A3 | 23 | 17 | 54 | 2 | 1 | 3 | — | — | — | — | — | 100 | CaO—$Al_2O_3$—$SiO_2$ |
| A4 | 17 | 16 | 58 | 2 | 2 | 5 | — | — | — | — | — | 100 | CaO—$Al_2O_3$—$SiO_2$ |
| A5 | 17 | 15 | 52 | 13 | 1 | 2 | — | — | — | — | — | 100 | CaO—$Al_2O_3$—$SiO_2$ |
| A6 | 15 | 13 | 65 | 2 | 2 | — | — | — | 3 | — | — | 100 | CaO—$Al_2O_3$—$SiO_2$ |
| A7 | 14 | 13 | 65 | 1 | 2 | — | 5 | — | — | — | — | 100 | CaO—$Al_2O_3$—$SiO_2$ |
| A8 | 10 | 15 | 67 | 1 | 3 | — | — | 4 | — | — | — | 100 | CaO—$Al_2O_3$—$SiO_2$ |
| A9 | 16 | 33 | 45 | 2 | 2 | 2 | — | — | — | — | — | 100 | CaO—$Al_2O_3$—$SiO_2$ |
| A10 | 13 | 31 | 48 | 5 | 1 | 2 | — | — | — | — | — | 100 | CaO—$Al_2O_3$—$SiO_2$ |
| A11 | 15 | 32 | 43 | 3 | 1 | 3 | — | — | 3 | — | — | 100 | CaO—$Al_2O_3$—$SiO_2$ |
| A12 | 16 | 31 | 46 | 3 | 1 | — | — | — | — | 3 | — | 100 | CaO—$Al_2O_3$—$SiO_2$ |
| A13 | 15 | 32 | 45 | 2 | 1 | — | — | — | 5 | — | — | 100 | CaO—$Al_2O_3$—$SiO_2$ |
| A14 | 33 | 34 | 22 | 6 | 2 | 3 | — | — | — | — | — | 100 | CaO—$Al_2O_3$—$SiO_2$ |
| A15 | 35 | 29 | 27 | 3 | 1 | — | — | — | 5 | — | — | 100 | CaO—$Al_2O_3$—$SiO_2$ |
| A16 | 38 | 27 | 28 | 1 | 1 | 3 | — | — | 2 | — | — | 100 | CaO—$Al_2O_3$—$SiO_2$ |
| A17 | 50 | 7 | 39 | 1 | 1 | 2 | — | — | — | — | — | 100 | CaO—$Al_2O_3$—$SiO_2$ |
| A18 | 33 | 9 | 51 | 1 | 1 | — | — | — | 2 | — | 3 | 100 | CaO—$Al_2O_3$—$SiO_2$ |
| A19 | 30 | 10 | 54 | 2 | 1 | 3 | — | — | — | — | — | 100 | CaO—$Al_2O_3$—$SiO_2$ |
| B1 | — | 70 | — | 30 | — | — | — | — | — | — | — | 100 | MgO/$Al_2O_3$ |
| B2 | — | 100 | — | — | — | — | — | — | — | — | — | 100 | $Al_2O_3$ |
| B3 | 25 | 20 | 50 | 4 | 1 | — | — | — | — | — | — | 100 | Anocite |

For each steel thus obtained, the toughness in the transverse direction was measured and the machinability in continuous cutting and intermittent cutting was evaluated.

[Toughness in Transverse Direction]

From each steel, a Charpy impact test piece having an R10 (mm) notch shape (shape: 10 mm×10 mm×55 mm) was cut out in the direction perpendicular to the rolling direction. Then, the impact value (Charpy impact value in the transverse direction) was measured. The following Table 4 shows the results.

[Evaluation of Machinability in Continuous Cutting]

To evaluate the machinability in continuous cutting, a round bar (normalized material) of 80 mm in diameter and 350 mm in length was descaled and the surface thereof was polished by about 2 mm. Using the sample thus obtained, periphery turning was conducted and then the average flank wear width Vb (depth of wear of tool) was measured by an optical microscope. The periphery cutting was conducted under the following conditions. The following Table 4 shows the results.

(Periphery Cutting Conditions)

Tool: cemented carbide P10 (JIS B4053)

Cutting speed: 200 m/min

Cutting length: 3000 m

Feed: 0.2 mm/rev

Cut depth: 1.5 mm

Lubrication: dry system

[Evaluation of Machinability in Intermittent Cutting]

To evaluate the machinability in intermittent cutting, depth of wear of the tool in end mill working was evaluated. The above-described plate material (annealed material) was descaled and the surface thereof was polished by about 2 mm to give an end mill test piece. More specifically, an end mill tool was attached to the cutting center main axis and the sample (thickness: 30 mm, width: 100 mm, length: 145 mm) produced above was fixed with a vice. Then, down-cut working was conducted under dry cutting atmospheres. Table 3 shows detailed working conditions. After repeating the continuous cutting by 200 cuts, the average flank wear width Vb was measured by an optical microscope. The following Table 4 shows the results.

TABLE 3

| Continuous cutting conditions | |
|---|---|
| Cutting tool | |
| Model | HSS end mill K-2SL mfd. by Mitsubishi Material Co. |
| Outer diameter | Diameter: 10.0 mm |
| Coating | TiAlN coating |
| Cutting conditions | |
| Cut depth in axial direction | 1.0 mm |
| Cut depth in radial direction | 1.0 mm |
| Feed | 0.117 mm/rev |
| Feeding speed | 558.9 mm/min |
| Cutting speed | 150 m/min |
| Rotational number | 4777 rpm |
| Cutting atmosphere | Dry system |

TABLE 4

| | Flank wear width Vb in continuous cutting (μm: 200 m/min, 3000 m) | Flank wear width Vb in intermittent cutting (μm: 150 m/min, after 200 cuts) | Charpy impact value (J) in transverse direction |
|---|---|---|---|
| A1 | 37 | 51 | 12.5 |
| A2 | 36 | 52 | 12.3 |
| A3 | 37 | 54 | 13.3 |
| A4 | 41 | 58 | 14.3 |
| A5 | 43 | 61 | 13.3 |
| A6 | 38 | 56 | 15.1 |
| A7 | 48 | 69 | 14.1 |
| A8 | 46 | 71 | 15.2 |
| A9 | 35 | 61 | 13.1 |
| A10 | 37 | 62 | 14.6 |
| A11 | 39 | 56 | 13.8 |
| A12 | 38 | 64 | 13.9 |
| A13 | 36 | 58 | 14.3 |
| A14 | 43 | 61 | 13.7 |
| A15 | 46 | 58 | 13.4 |
| A16 | 45 | 55 | 14.5 |
| A17 | 52 | 57 | 12.6 |
| A18 | 49 | 66 | 12.8 |
| A19 | 48 | 63 | 13.6 |
| B1 | 60 | 75 | 7.3 |
| B2 | 103 | 59 | 6.9 |
| B3 | 36 | 145 | 11.3 |

The data given in Tables 1 to 4 indicate that the sample Nos. A1 to A19 satisfying the requirements of the invention show small flank wear width of the tool in both of the continuous cutting and the intermittent cutting, thus showing excellent machinabilities in both of the continuous cutting and the intermittent cutting.

In contrast thereto, in the sample Nos. B1 to B3 each having an excessively large Al content, $Al_2O_3$ was formed in a large amount and the depth of wear of the tool at cutting was increased.

Although the invention has been illustrated in detail by referring to specific embodiments, it is clear to those skilled in the art that various modifications and changes can be made without departing from the spirit and scope of the invention.

The present application is based on Japanese Patent Application No. 2008-016653 filed on Jan. 28, 2008, the contents of which are incorporated herein by reference.

Industrial Applicability

According to the invention, it is possible to obtain a steel for machine and structural use in which the S content is reduced to elevate the strength and each component of oxide inclusions is appropriately controlled to lower the melting point of the inclusions as a whole and facilitate the deformation thereof, thereby achieving excellent machinability (in particular, tool life) in both of intermittent cutting with HSS tools and continuous cutting with carbide tools.

The invention claimed is:

1. A machine part obtained by cutting a steel for machine and structural use having excellent machinability, said steel comprising an oxide inclusion comprising:

CaO: 10 to 55 mass %;

$SiO_2$: 20 to 70 mass %;

$Al_2O_3$: more than 0 and 35 mass % or less;

MgO: more than 0 and 20 mass % or less;

MnO: more than 0 and 5 mass % or less; and one or more members selected from the group consisting of $Li_2O$, $Na_2O$, $K_2O$, BaO, SrO and $TiO_2$: 0.5 to 20 mass % in total, wherein a total mass of an average composition of the oxide inclusion in 100 mass %.

2. The machine part of claim 1, wherein the oxide inclusion comprises as the average composition:

CaO: 10 to 50 mass %;

$SiO_2$: 20 to 70 mass %;

$Al_2O_3$: 7 to 35 mass %;

MgO: 1 to 13 mass %;

MnO: 1 to 3 mass %; and one or more members selected from the group consisting of $Li_2O$, $Na_2O$, $K_2O$, BaO, SrO and $TiO_2$: 2 to 6 mass % in total.

3. The machine part of claim 1, wherein said steel comprises:

C: 0.1 to 1.2 mass %;

Si: 0.03 to 2 mass %;

Mn: 0.3 to 1.8 mass %;

P: more than 0 and 0.03 mass % or less;
S: more than 0 and 0.02 mass % or less;
Cr: 0.3 to 2.5 mass %;
Al: 0.0001 to 0.01 mass %;
Ca: 0.0001 to 0.005 mass %;
Mg: 0.0001 to 0.005 mass %;
N: more than 0 and 0.009 mass % or less;
O: more than 0 and 0.005 mass % or less;
at least one of
one or more elements selected from the group consisting of Li, Na, K, Ba and Sr: 0.00001 to 0.0050 mass % in total; and
Ti: 0.01 to 0.5 mass %; and
iron and an inevitable impurity.

4. The machine part of claim 2, wherein said steel comprises:
C: 0.1 to 1.2 mass %;
Si: 0.03 to 2 mass %;
Mn: 0.3 to 1.8 mass %;
P: more than 0 and 0.03 mass % or less;
S: more than 0 and 0.02 mass % or less;
Cr: 0.3 to 2.5 mass %;
Al: 0.0001 to 0.01 mass %;
Ca: 0.0001 to 0.005 mass %;
Mg: 0.0001 to 0.005 mass %;
N: more than 0 and 0.009 mass % or less;
O: more than 0 and 0.005 mass % or less;
at least one of
one or more elements selected from the group consisting of Li, Na, K, Ba and Sr: 0.00001 to 0.0050 mass % in total; and
Ti: 0.01 to 0.5 mass %; and
iron and an inevitable impurity.

5. The machine part of claim 3, wherein said steel further comprises:
Mo: more than 0 and 0.5 mass % or less.

6. The machine part of claim 4, wherein said steel further comprises:
Mo: more than 0 and 0.5 mass % or less.

7. The machine part of claim 1, wherein said oxide inclusion comprises at least one member selected from the group consisting of BaO, SrO and $TiO_2$.

8. The machine part of claim 7, wherein said steel comprises:
C: 0.1 to 1.2 mass %;
Si: 0.03 to 2 mass %;
Mn: 0.3 to 1.8 mass %;
P: more than 0 and 0.03 mass % or less;
S: more than 0 and 0.02 mass % or less;
Cr: 0.3 to 2.5 mass %;
Al: 0.0001 to 0.01 mass %;
Ca: 0.0001 to 0.005 mass %;
Mg: 0.0001 to 0.005 mass %;
N: more than 0 and 0.009 mass % or less;
O: more than 0 and 0.005 mass % or less;
at least one of
one or more elements selected from the group consisting of Li, Na, K, Ba and Sr: 0.00001 to 00050 mass % in total; and
Ti: 0.01 to 0.5 mass %; and
iron and an inevitable impurity.

9. The machine part of claim 8, wherein said steel further comprises:
Mo: more than 0 and 0.5 mass % or less.

10. The machine part of claim 1, wherein said part is selected from the group consisting of a gear, a shaft, a pulley, and a contant-velocity joint, all of which are suitable for gear transmission devices, crank shafts, and connecting rods.

* * * * *